United States Patent [19]

Firth et al.

[11] Patent Number: 4,836,274

[45] Date of Patent: Jun. 6, 1989

[54] LIQUID ALKALI METAL-WATER, TUBE-IN-SHELL STEAM GENERATORS

[75] Inventors: George F. Firth, Cheshire; Owen Hayden, Greater Manchester, both of England

[73] Assignee: National Nuclear Corporation Limited, Cheshire, England

[21] Appl. No.: 62,595

[22] Filed: Jun. 16, 1987

[30] Foreign Application Priority Data

Apr. 7, 1987 [GB] United Kingdom ..... 8708260

[51] Int. Cl.[4] ..... G01M 3/04; F28F 13/08; G21C 17/00

[52] U.S. Cl. ..... 165/11.1; 165/70; 165/159; 165/160; 165/161; 376/250; 73/40; 73/40.7

[58] Field of Search ..... 165/11.1, 70, 159, 161; 73/40, 40.5 R, 40.7; 376/250

[56] References Cited

U.S. PATENT DOCUMENTS

| | | | |
|---|---|---|---|
| 3,811,498 | 5/1974 | Ferraro et al. | 165/161 |
| 3,907,026 | 9/1975 | Mangus | 165/70 |
| 3,943,751 | 3/1976 | Akiyama et al. | 73/27 R |
| 3,975,943 | 8/1976 | Brachet | 165/11.1 |
| 4,072,183 | 2/1978 | Fraas | 165/70 |
| 4,199,975 | 4/1980 | Schrock et al. | 73/40.7 |
| 4,325,171 | 4/1982 | Nobles | 165/161 |
| 4,418,748 | 12/1983 | Pouderoux et al. | 165/161 |
| 4,515,748 | 5/1985 | Frabregue | 165/11.1 |
| 4,665,866 | 5/1987 | Wepfer | 165/159 |
| 4,724,799 | 2/1988 | Traiteur et al. | 165/11.1 |

FOREIGN PATENT DOCUMENTS

| | | | |
|---|---|---|---|
| 0564508 | 7/1977 | U.S.S.R. | 165/11.1 |
| 0000876 | of 1873 | United Kingdom | 165/161 |
| 2006964 | 5/1979 | United Kingdom . | |

*Primary Examiner*—Albert W. Davis Jr.
*Assistant Examiner*—John K. Ford
*Attorney, Agent, or Firm*—William R. Hinds

[57] ABSTRACT

A proportion of the liquid metal flow passing through a fast reactor steam generator unit (SGU) is diverted past the outlet to a quiescent zone in the region of immersed tube-to-tubeplate welds at the water entry ends of the tubes, into which zone are given off any hydrogen bubbles which may result from a water leak into the liquid metal. The liquid metal in this zone is caused to flow through a weir system above which there is a gas space for collection of hydrogen, suitable means being provided for detection of hydrogen in this space. The hydrogen is entrained at the water inlet tube plate, the invention making use of the slow solution rate of hydrogen in sodium at lower temperatures prevailing in the quiescent zone at the water inlet end.

7 Claims, 5 Drawing Sheets

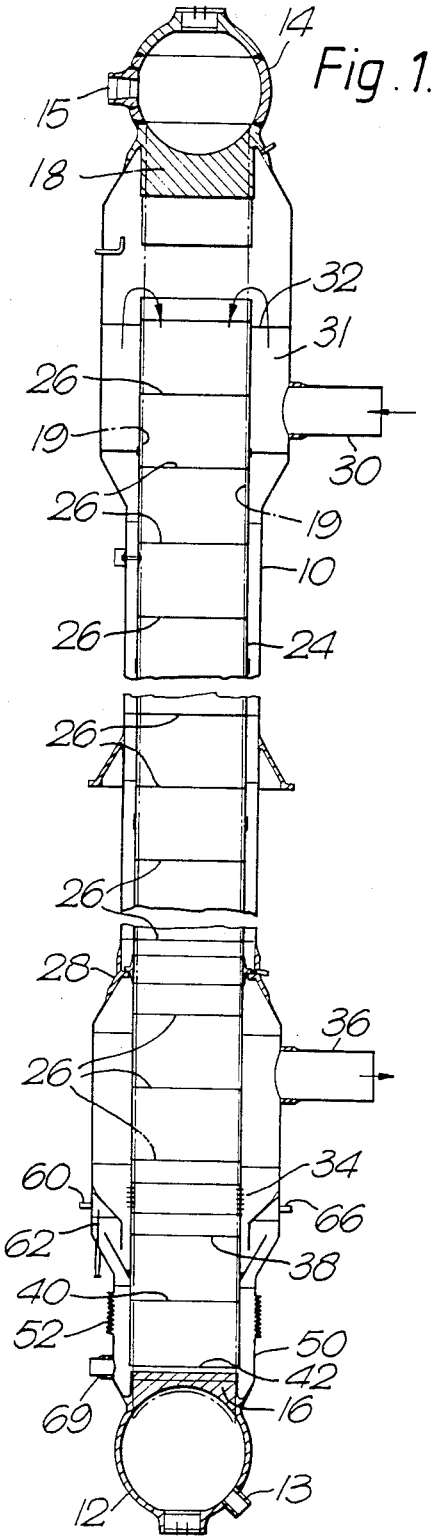
Fig. 1.
Fig. 2.
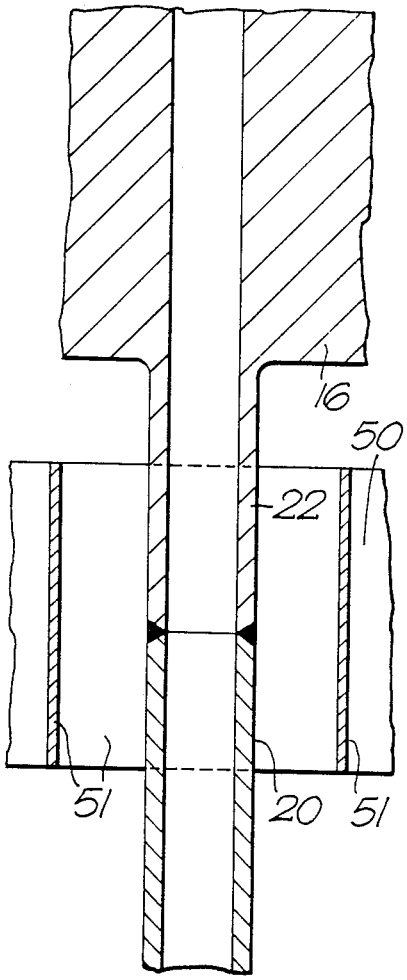

LIQUID ALKALI METAL-WATER, TUBE-IN-SHELL STEAM GENERATORS

This invention relates to heat exchangers and, in particular to tube-in-shell heat exchangers of the type in which a liquid alkali metal, usually sodium, is circulated through the shell while water, in its liquid and/or vapour state, is passed through the tubes. Such heat exchangers (steam generators) are used in liquid metal cooled fast fission nuclear reactor plants.

In general, in steam generators for nuclear reactor plants the water/steam conducting tubes are connected by welding at each end to a tube plate or tube plates depending on whether the tubes are U-shaped, in which case there may be only one tube plate involved, or straight or J-shaped in which case there are two tube plates. One area of concern is the possibility of water/-steam leakage into the sodium since this can cause severe damage in view of the violent nature of the water-sodium interactin. The welded connections between the tubes and the tubeplate(s) are considered to be potentially susceptible in this respect.

Where the steam generator is of the type employing straight or J-shaped tubes extending between an upper tubeplate and a lower tubeplate, the welded connections between the tubes and the upper tubeplate may be located above the sodium level within a cover region of inert gas such as Argon. This cover region may then be monitored by sampling the cover gas to detect the presence of hydrogen in the cover gas, this being indicative of any sodium-water interaction since hydrogen is one of the products of such an interaction. The welded connections between the tubes and the lower tubeplate however are immersed in sodium and the technique that has evolved for detection of hydrogen in this region involves sampling the bulk sodium to detect hydrogen dissolved in the sodium, detection in this case being effected by separating at least a fraction of the hydrogen from the sodium by means of a nickel membrane through which the dissolved hydrogen can diffuse.

Detection of hydrogen in the cover gas region provides a sensitive and relatively rapid process but leak detection at the lower tube plate where reaction products are released directly into sodium and carried away in the sodium flow is recognised to be a more difficult proposition especially when the reaction products are mixed with the full circuit sodium flow. Under such circumstances, using existing techniques, it would only be possible to detect changes in the background level of hydrogen dissolved in the sodium over a relatively long timescale, eg hours. This may be useful for small leaks of a non-wasting size (if such leaks can remain non-wasting over such a timescale) but doubts exist as to its adequacy in the case of any leaks in a size range which cause rapid wastage.

The philosophy underlying the existing technique of sodium sampling to detect dissolved hydrogen appears to be based on the premise that hydrogen released into the sodium dissolves therein with the consequence that sodium sampling is necessary to detect the dissolved hydrogen.

According to the present invention there is provided a liquid alkali metal-water, tube-in-shell steam generator with tube-to-tubeplate connections immersed in the liquid alkali metal, characterised by means for directing any hydrogen bubbles arising in the region of the immersed tube-to-tubeplate connections at the water inlet region to a collection zone, and means for monitoring for the presence of hydrogen in the collection zone.

The present invention is based on the recognition that, whilst hydrogen tends to dissolve in sodium, the rate of dissolution is sufficiently slow at the temperatures prevailing at the water inlet region that it is feasible to collect hydrogen in the gas phase thereby avoiding the need for local or the bulk sampling of sodium.

In a presently-preferred embodiment of the invention, the arrangement is such that the tube-to-tubeplate connections at the water inlet region are disposed in a substantially quiescent zone of liquid metal alkali whereby the water inlet tubeplate is thermally protected from the hotter regions of the liquid metal flow (ie so that any hydrogen bubbles that develop at said connections do so in a relatively low temperature region of the steam generator) and whereby any hydrogen bubbles developing adjacent the connections at the water inlet region are not transported away in the bulk flow of liquid metal through the steam generator. In such an embodiment, the generator may include a liquid metal outlet port spaced from said connections and flow resistance means for allowing a relatively small proportion (eg of the order of 2% of the total flow) of liquid metal to flow past the outlet to form the substantially quiescent zone referred to above.

The flow resistance means may comprise one or more tube spacing grids designed to provide a high resistance flow path for the liquid metal and arranged adjacent the liquid metal outlet port so as to admit a low flow rate of liquid metal into the substantially quiescent zone and provide a barrier to prevent passage of gas through the grid either by increased coolant velocity to counteract the bouyancy forces acting on the bubbles or by surface tension effects produced by restricted openings such that passage of the bubbles through the openings is resisted.

There may be a return flow path to allow liquid metal in the quiescent zone to return to the bulk flow of liquid metal through the steam generator and the return path may traverse the collection zone so that any hydrogen bubbles are transported to the collection zone by the liquid metal circulating through the substantially quiescent zone.

The flow resistance means is preferably such as to create a liquid metal velocity of sufficient velocity to overcome the buoyance forces acting on any hydrogen bubbles and hence minimise any tendency for such bubbles to rise into the bulk flow of liquid metal.

The flow restricting grid or grids may take the form of plates in which tube-receiving apertures have been produced in such a way that the marginal portion around each aperture forms a skirt projecting generally axially of and encircling the tube passing through that aperture. The skirt may in this way act in the manner of a leaf seal in making contact with the tube. The tube may be a close fit within the encircling skirt, the closeness of the fit governing the extent to which fluid can flow from one side of the grid to the opposite side. The grid may be of thin sheet metal to facilitate formation of the leaf seal-type skirts during production of the apertures (eg by way of a punching operation) and the thin grid may be locally stiffened by the incorporation for example of integrally formed stiffening formations or by the use of a separate supporting structure.

In an alternative arrangement, the flow restricting grid may have apertures for receiving the tubes with clearance and, to afford increased flow resistance, the grid may be provided with elements, for example in the form of washers which may be hexagonally-shaped, arranged to form together with the grid a labyrinthine flow path from one side of the grid to the opposite side.

The above-mentioned specific grid designs whilst applicable to the steam generator of the present invention are envisaged as being applicable to other forms of heat exchangers either where a reduced flow of fluid from one side of the grid to the opposite side is required or where the grid is required to provide a seal against flow from one side to the opposite side. In the latter instance for example, the skirts of the first-mentioned grid embodiment may each sealingly contact the associated tube so as to substantially prevent any leakage past the grid.

The invention will now be described by way of example only with reference to the accompanying drawings, in which:

FIG. 1 is a sectional view of a vertical, straight tube steam (SGU) generating unit in accordance with the invention;

FIG. 2 is a diagrammatic view illustrating one form of tube-to-tubeplate joint;

Figure 3:
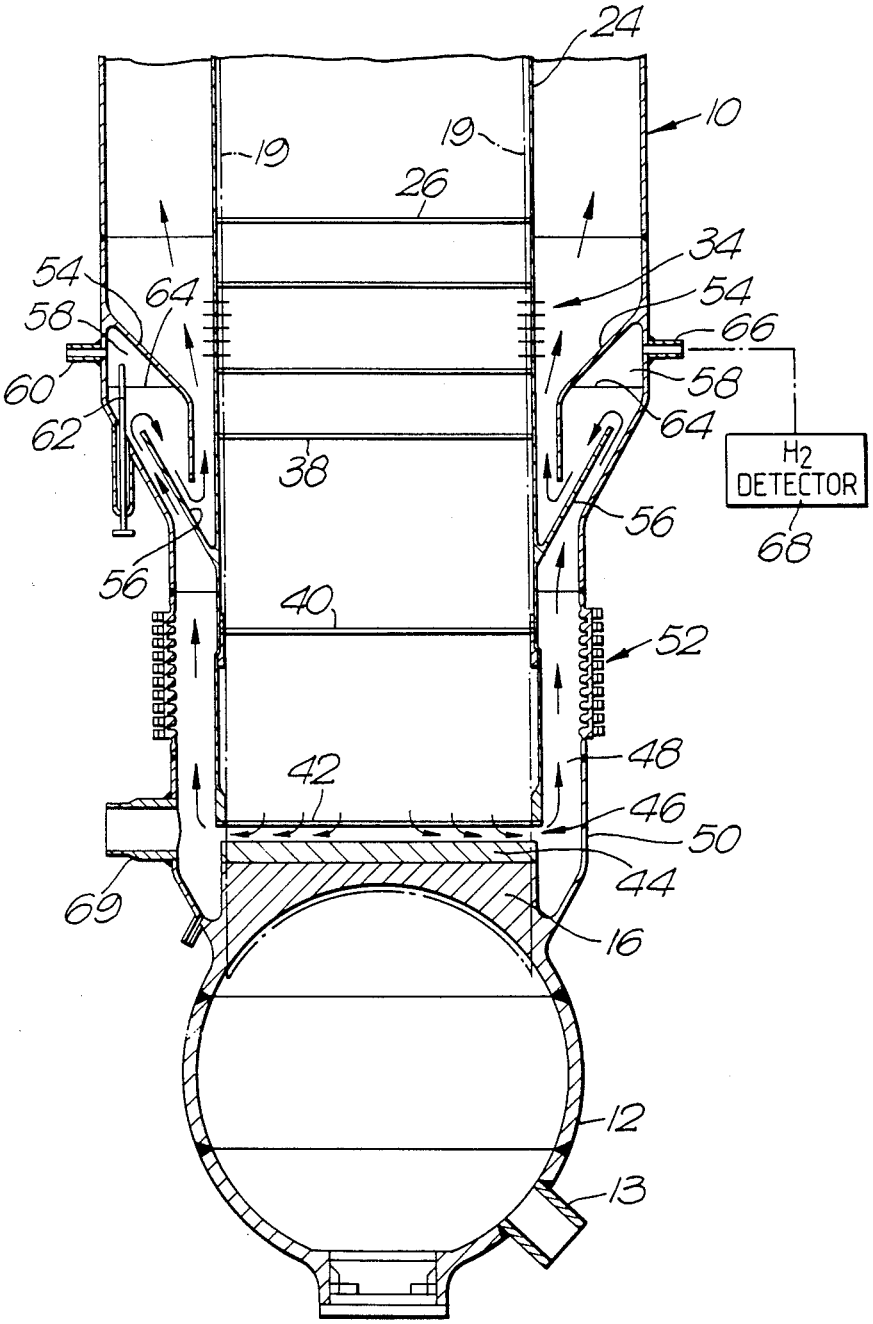
FIG. 3 is an enlarged view of the lower part of the SGU seen in FIG. 1.

Referring to FIG. 1 of the drawings, the sodium-water SGU illustrated is of the straight tube, bellows-in-shell type and comprises a vertically-elongated main shell 10 extending between a feed water inlet header 12 with inlet nozzle 13 and a steam outlet header 14 with outlet nozzle 15. Each header 12, 14 incorporates a tube-plate 16, 18 and a tube bundle (not illustrated for clarity) extends between the two tubeplates 16, 18 to conduct water/steam through the interior of the shell from the inlet header 12 to the outlet header 14. The tube-to-tubeplate joints may be of the tube-to-pintle fusion butt weld type shown in FIG. 2 in which an individual tube 20 and pintle 22 are illustrated, it being understood that in practice there will typically be in excess of 1500 tubes, each having tube-to-pintle welds at each tubeplate 16, 18.

The tube bundle (shown in phantom outline —see reference 19 in FIGS. 1 and 3) is enclosed within a circular-section flow shroud 24 which serves to limit tube bundle by-pass flow of liquid sodium, protect the main shell 10 from thermal transcients and any sodium-water reaction wastage, and provide a means for locating support grids 26 for the tube bundle without impairing the integrity of the main shell 10 or resorting to tie rods. The shroud 24 is supported from the main shell by a forged-flange bolted joint 28.

Sodium enters the SGU main shell 10 via inlet nozzle 30 and is admitted to the interior of the flow shroud 24 after passage through an annular chamber 31 and an annular distribution grid 32 which serves to produce a substantially circumferentially uniform velocity distribution in the sodium prior to entry into the tube bundle. The sodium flow then proceeds into the shroud (see arrows) and downwardly via grids 26 in heat enchange with the water/steam carrying tubes before the main bulk of the sodium flow emerges laterally at openings in section 34 of the shroud and leaves the main shell 10 through the outlet nozzle 36.

As illustrated on a larger scale in FIG. 3, the shroud 24 continues downwardly beyond the outlet section 34 to introduce a small proportion (eg about 2%) of the total sodium flow into the lower region of the SGU to form a buffer or substantially quiescent zone of sodium which acts as a thermal barrier to protect the lower tubeplate 16 from sodium temperature transcients at the SGU sodium outlet, ie by forming a stratified region of relatively low temperature sodium in the region extending downwardly from the outlet shroud section 34 to the lower tube plate 16. The reduced flow of sodium into the buffer zone is achieved by grids 38, 40 and 42, the grids 38 and 40 being flow-redistributing grids for creating a substantial amount of crossflow to mix the sodium flows and avoid hot spots developing in the event of some of the steam tubes having to be plugged at some stage in the life of the SGU. The grid 42 is a high resistance grid which is penetrated by the tube bundle but permits passage of only about 2% of the total sodium flow. The tube-to-tubeplate connections at the lower tube plate are protected by a wastage grid 44 whose function is described in greater detail hereinafter. The shroud 24 terminates a short distance above the wastage grid 44 to leave a clearance through which sodium may discharge into an annular region 48 between the shroud 24 and outer wall of the lower SGU shell 50 which is coupled to the main shell 10 via bellows 52.

The sodium exiting via clearance 46 travels upwardly along the annular region 48 and negotiates a retroverted flow path defined by plates 54, 56 before returning to the bulk flow of sodium (see arrows). The plates 54, 56 enable a gas space 58 to be formed which is normally filled with an inert gas such as Argon via nozzle 60. A level gauge 62 enables the sodium level to be monitored in this region so that, by control of the gas supply to the space 58, the level 64 can be maintained substantially constant. A nozzle 66 is provided for connection of the gas space to a hydrogen-detecting instrument 68.

It will be seen that, in addition to creating a substantially quiescent zone of sodium in the region of the lower tubeplate 16, the low sodium flow also passes over the tubeplate 16 and serves to transport any hydrogen bubbles arising in this region to the gas space 58 which acts as a collection chamber for any hydrogen generated. If desired, the sodium flow across the tube plate 16 may be enhanced by inducing a forced flow involving drawing the sodium through a recirculatory loop, part of which may be external to the SGU, shell, by means of a pumping system. By providing a substantially quiescent zone of sodium in the vicinity of the lower tubeplate 16, the sodium immediately adjacent the latter will be relatively cold when compared with the sodium temperature prevailing at higher regions of the SGU. In this way, a reduced rate of dissolution of hydrogen in sodium is promoted thereby allowing a significant quantity of any hydrogen produced to be transported in the gas phase to the gas space or collection zone 58. By appropriate design of the high resistance grid 42, any tendency for hydrogen bubbles to migrate upwardly through the grid 42 under the action of buoyancy forces (and hence merge with the high temperature sodium in the region of the outlet 36) can be reduced or prevented by ensuring that the downward sodium velocity through the grid 42 is greater than the upward bubble terminal velocity due to buoyancy forces and/or surface tension effects are sufficient to prevent the bubbles passing through the grid.

From the foregoing, it will be seen that any hydrogen produced, as a result of for example a small leak of water or steam into the sodium in the vicinity of the lower tubeplate 16, will be transported to the annular gas space 58 where it can be detected by the hydrogen sensor 68. The transport time from the point of production of a hydrogen bubble adjacent the tubeplate 16 to its emergence in the gas space 58 may be relatively rapid, ie making it feasible to detect hydrogen generation before the primary source of a leak from one tube can give rise to a secondary leak or leaks by other tubes in its vicinity as a result of erosion of the latter by the impingement of the steam and sodium-water reaction products from the primary source on neighbouring tubes. Thus, in response to detection of hydrogen in the gas space 58, the SGU may be shut down and the sodium drained off, eg via drain-off points such as dump nozzle 69, to restrict propagation of the leak to other tubes and allow subsequent repair of the leaking tube or tubes.

In practice, it may necessary to allow a greater margin of safety by reducing the rate at which a leak developing at one site can cause erosion at neighbouring sites. For this reason, a wastage grid 44 is provided immediately adjacent the lower tubeplate 16. The function of the wastage grid 44 is to shroud each tube-to-tubeplate welded connection (these being the most vulnerable sites in terms of the development of leaks) within a respective cell so that any plume of steam and sodium-water reaction products developing as a result of a small leak from a particular welded connection impinges initially on the surrounding shrouding cell thereby protecting the neighbouring tubes at least until the plume has erorded through the thickness of the cell wall. The wastage tube may be fabricated as a grid of intersecting strips 51 (see FIG. 2) of erosion resistant metal forming cells through which the tubes pass. The provision of a wastage grid therefore substantially extends the time available for the detection of a small leak before shutdown of the SGU thereby reducing the risk of damage to surrounding tubes.

Figure 4:
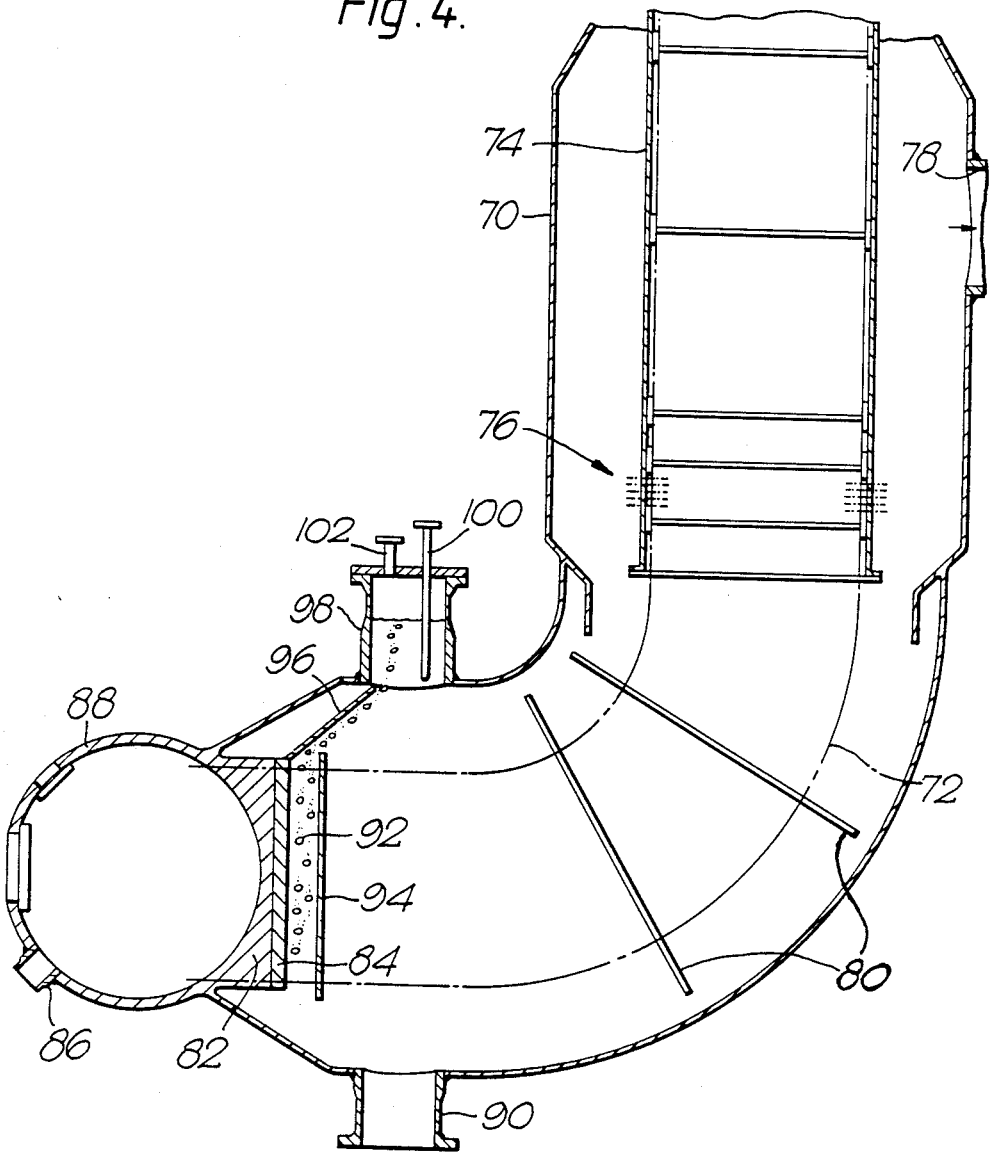
FIG. 4 is a similar view to FIG. 3 but of a J-tube SGU.

FIG. 4 illustrates the lower part of an alternative form of SGU in which the shell 70 and the tube bundle 72 (shown in phantom outline) are of J-configuration. Apart from its lower part, the SGU of FIG. 4 is generally similar to that of FIGS. 1–3 and the following description will be confined to those features which are different in the context of the invention. The main sodium flow exists the flow shroud 74 via outlet section 76 and leaves the SGU via the outlet 78. A small proportion of the main flow is allowed to pass downwardly via high resistance grids 80 to form a substantially quiescent zone at the lower end of the SGU. The lower tube plate 82 is connected to the tube bundle 72 via welded joints (see FIG. 2) and the joints are shrouded by a wastage grid 84 as described previously. Feedwater is supplied to the tube bundle via nozzle 86 of the header 88. A vent line 90 is provided to drain off sodium when necessary.

In this embodiment, any hyrogen bubbles 92 evolving as a result as leakage in the vicinity of the lower tube plate are guided by baffle plates 94, 96 into a collection chamber 98 provided with a level sensor 100 and a nozzle 102 for connection to a hydrogen sensor. Again, if desired, the sodium flow for transporting the hydrogen bubbles may be enhanced by means of a pumped recirculatory flow. As in the embodiment of FIG. 1, the quiescent zone allows at least a proportion of the hydrogen to remain in the gas phase so that bubbles of any hydrogen produced collect in the chamber 98 where the presence of hydrogen can be detected in the Argon gas normally present in the chamber. Thus, in both embodiments, it is unnecessary to extract samples of sodium and extract hydrogen from the sodium samples in order to detect sodium-water interaction.

Figure 5:
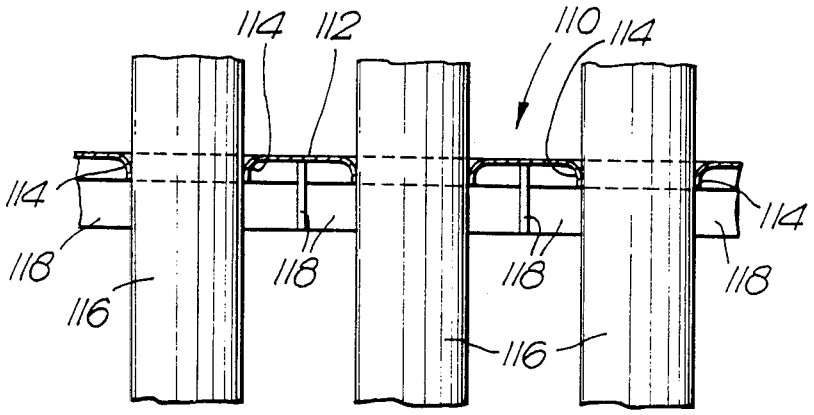
FIG. 5 is a view illustrating a novel form of high resistance grid which may be used in a SGU according to the invention.

FIG. 5 illustrtes diagrammatically one form of high resistance grid which may find application in the above-described embodiments of the present invention but may also find application elsewhere in circumstances where flow past the grid is to be minimised. As shown, the grid 110 comprises a very thin perforated plate 112 which may be produced by punching holes in a sheet metal plate such that annular skirts 114 are created which co-operate with the steam/water tubes 116 in the manner of a leaf seal and reduce flow past the grid to the desired proportions. The relatively flimsy plate 112 may have inherent rigidity imparted to by incorporation of localised integral stiffening formations or it may be supporting by a grid of suitably-shaped intersecting straps 118 serving to stiffen the grid plate 112 in the inter-tube spaces.

Figure 6:
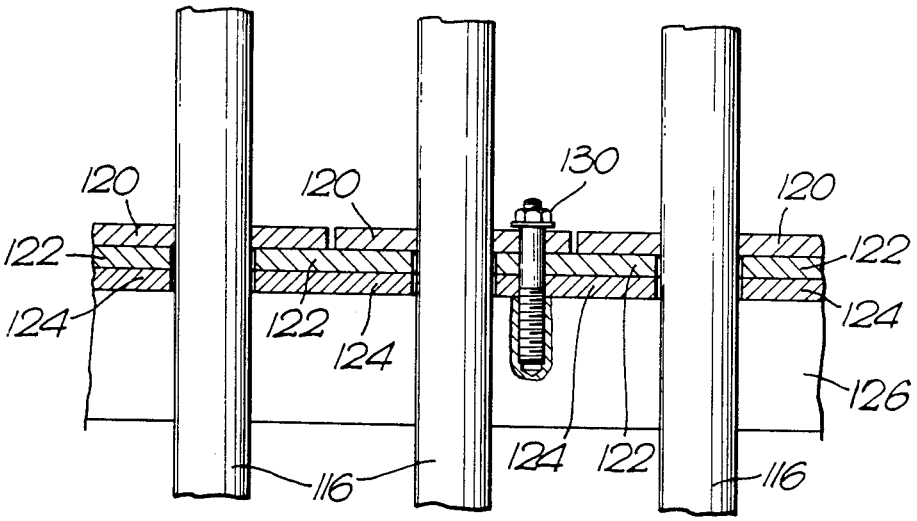
FIG. 6 is a view similar to that of FIG. 5 showing another form of grid.
Figure 7:
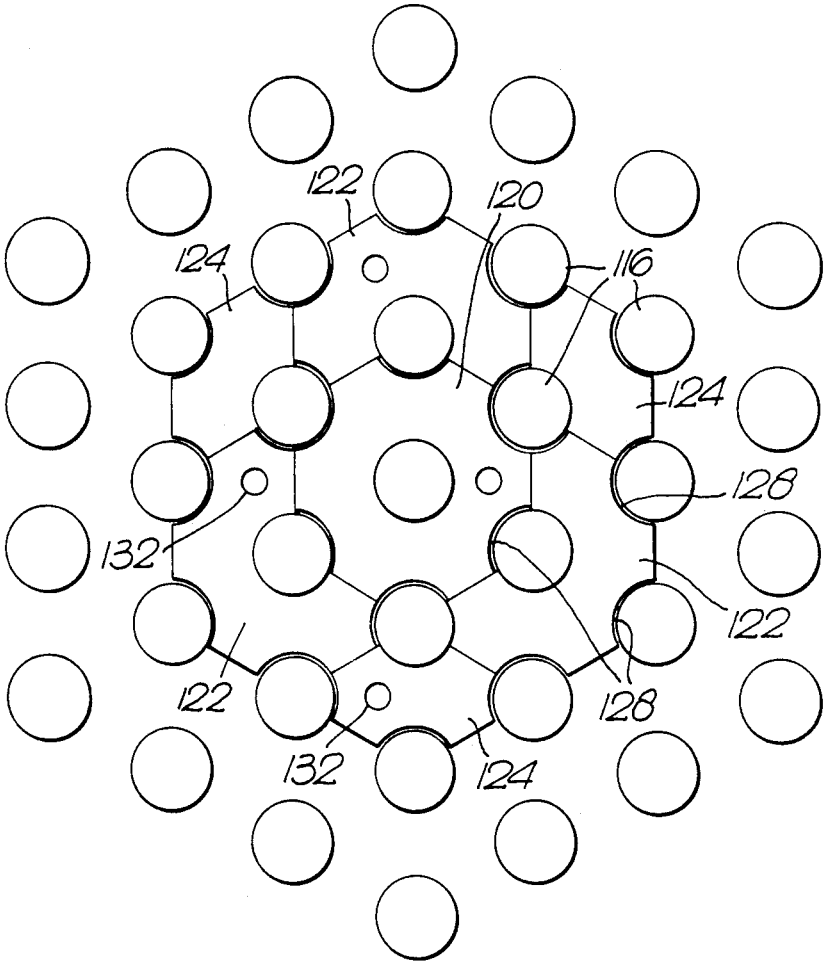
FIG. 7 is a fragmentary plan view of the grid of FIG. 6.

Referring to FIGS. 6 and 7, there is shown another form of high resistance grid which like that of FIG. 5 may find application in other forms of heat exchanger design. The grid is formed by a number of layers of hexagonal plates 120, 122, 124 supported on an open-work structure 126 and, arranged with their pitch centres offset from one layer to the next in such a way that the small gaps between the hexagonal plates in one layer are converted by the plates of the adjacent layer or layers thereby providing labyrinthine, and hence high resistance, fluid flow paths through the grid. As shown, each hexagonal plate is formed with a central tube-receiving aperture and the vertices of each plate are formed with part-circular cut-away portions 128 to conform with the profiles of the neighbouring tubes. The layers of plates 120, 122, 124 forming the grid may be secured together by threaded fasteners 130 passing through aligned holes 132 in the plates and engaging in the support structure 126.

We claim:

1. In a liquid alkali metal-water, tube-in-shell steam generator with tube-to-tubeplate connections for water entry ends of the tubes immersed in the liquid alkali metal, the improvement comprising means for forming in the vicinity of said tube-to-tubeplate connections a gas space constituting a bubble collection zone above a localized surface of the liquid alkali metal, which localized surface is separate from any other surface level of the liquid alkali metal in the steam generator, means for directing any hydrogen bubbles arising in the region of said immersed tube-to-tubeplate connections to said surface for escape as gas into the collection zone, and means for monitoring for the presence of hydrogen in the collection zone.

2. A steam generator as claimed in claim 1 constructed and arranged such that the region of said immersed tube-to-tubeplate connections and the surface with the collection zone thereabove are disposed in a relatively quiescent zone of liquid alkali metal.

3. A steam generator as claimed in claim 2 including flow resistance means for allowing only a relatively small proportion of liquid metal to flow to the region of the immersed tube-to-tubeplate connections to form the said quiescent zone.

4. A steam generator as claimed in claim 3 including a liquid metal outlet port spaced from said connections, and in which the flow resistance means comprises one or more tube spacing grids designed to provide a high resistance flow path for the liquid metal and arranged adjacent the liquid metal outlet port so as to admit a low flow rate of liquid metal into the quiescent zone and provide a barrier to prevent passage of gas through the grid.

5. A steam generator as claimed in claim 3 in which there is a return flow path to allow liquid metal in the quiescent zone to return to the bulk flow of liquid metal through the steam generator and the return path traverses the collection zone so that any hydrogen bubbles are transported to the collection zone by the liquid metal circulating through the substantially quiescent zone.

6. A steam generator as claimed in claim 4 in which the flow restricting grid or grids take the form of plates in which tube-receiving apertures have been produced in such a way that the marginal portion around each aperture forms a skirt projecting generally axially of and encircling the tube passing through that aperture.

7. A steam generator as claimed in claim 4 in which the flow restricting grid includes an open framework structure which has apertures for receiving the tubes with clearance and, to afford increased flow resistance, the grid in the form of washers which are hexagonally-shaped, arranged to form together with the framework structure a labyrinthine flow path from one side of the grid to the opposite side.

* * * * *